United States Patent [19]

Gresens

[11] Patent Number: 4,829,680

[45] Date of Patent: May 16, 1989

[54] METHOD OF HEAT TREATMENT OF A LENGTH OF MATERIAL IN A TENTERING MACHINE

[75] Inventor: Harry Gresens, Benningen, Fed. Rep. of Germany

[73] Assignee: Bruckner Trockentechnik GmbH & Co. KG, Fed. Rep. of Germany

[21] Appl. No.: 24,710

[22] Filed: Mar. 11, 1987

[30] Foreign Application Priority Data

Mar. 17, 1986 [DE] Fed. Rep. of Germany ..... 3608902

[51] Int. Cl.[4] ..... F26B 13/10

[52] U.S. Cl. ..... 34/31; 34/44; 34/48; 34/52; 34/155

[58] Field of Search ..... 34/23, 31, 48, 52, 155, 34/158, 160, 162, 163

[56] References Cited

U.S. PATENT DOCUMENTS

| | | | |
|---|---|---|---|
| 4,204,337 | 5/1980 | Roos et al. | 34/52 |
| 4,301,072 | 2/1985 | Jacobi et al. | 34/155 |
| 4,575,952 | 3/1986 | Bodeman et al. | 34/155 |
| 4,614,044 | 9/1986 | Fiedler et al. | 34/52 |
| 4,656,756 | 4/1987 | Schiffers | 34/155 |

FOREIGN PATENT DOCUMENTS

| | | | |
|---|---|---|---|
| 2721965 | 11/1978 | Fed. Rep. of Germany | 34/52 |

*Primary Examiner*—Henry A. Bennett

*Attorney, Agent, or Firm*—Sheldon & Mak

[57] ABSTRACT

A method of heat treatment of a length of material in a tentering machine is characterized by the following steps:

(a) first of all a material-specific characteristic value is determined by measuring a material sample;

(b) then at least one parameter for the method of heat treatment is calculated taking account of this material-specific characteristic value and is set before the commencement of the heat treatment;

(c) during the heat treatment at least one characteristic quantity for the method of heat treatment is measured, compared with a calculated value for this characteristic quantity, a correction signal corresponding to the difference between the measured value and the calculated value is formed and the present parameter of the method of heat treatment is altered in accordance with this correction signal.

13 Claims, 2 Drawing Sheets

≤60°C
2f
2e
2d
2c
2b
2a
60°C
~20°C 2f
2e
2d
2c
~190°C
2b
2a
~20°C 2f
2e
2d
2c
2b
~200°C
2a
~20°C

METHOD OF HEAT TREATMENT OF A LENGTH OF MATERIAL IN A TENTERING MACHINE

BACKGROUND OF THE INVENTION

The invention relates to a method of heat treatment of a length of material in a tentering machine, particularly for drying, fixing and/or condensing.

It has been usual in the past to regulate a tentering machine on the so-called feed-back principle, which will be explained using the example of regulating the temperature by means of an air heater. A temperature sensor is located behind the air heater and passes its measured value to a regulator which compares the measured value with a preset theoretical value. The difference between these two values results in a control value which acts on a control member, which in the hypothetical case discussed here can for example be a regulating valve which alters the quantity of flow on the fluid side of the air heater. This feedback coupling closes the control circuit. The air temperature must be altered before the measuring and control circuit can emit a new setting signal.

The application of this conventional feed-back regulation to the operation of a tentering machine has the disadvantage that particularly before the commencement of heat treatment the plant is not yet at an optimum setting, which leads to uneconomic operation with unnecessarily high energy costs and in certain circumstances impairs the quality of the material.

SUMMARY OF THE INVENTION

The object of the invention, therefore, is to develop a method of heat treatment of a length of material in a tentering machine which is distinguished by being regulated in a particularly economic manner and at the same time treating the material gently.

This object is achieved according to the invention by the following steps.

In the method according to the invention at least one material-specific characteristic value is first of all determined by measuring a material sample.

Then, taking account of this material-specific characteristic value, one parameter of the heat treatment method is calculated and set before the commencement of the heat treatment.

During the heat treatment at least one characteristic quantity for the method of heat treatment is measured, compared with a calculated value for this characteristic quantity, a correction signal corresponding to the difference between the measured value and the calculated value is formed and the set parameter of the method of heat treatment is altered according to this correction signal.

Thus the method according to the invention is based on a feed-forward principle (forward regulation). First of all (before commencement of the heat treatment) the necessary control values are calculated by determining material-specific characteristic values of a material sample and all control members are positioned in advance so that even at the start the heat treatment is carried out with almost optimum setting of all parameters. In this way the energy consumption which is considerable in some tentering machine processes is already minimised at the commencement of heat treatment (for instance when switching over to a different material) and impairment of the quality of the material is reliably avoided even at the commencement of heat treatment.

From the measured material-specific characteristic value, the predetermined length of the heat treatment zone and possibly other predetermined data, the speed of the tentering machine is advantageously calculated as a parameter of the heat treatment method and is set before the commencement of the heat treatment.

DESCRIPTION OF THE PREFERRED EMBODIMENTS

Figures 1, 2, 3:
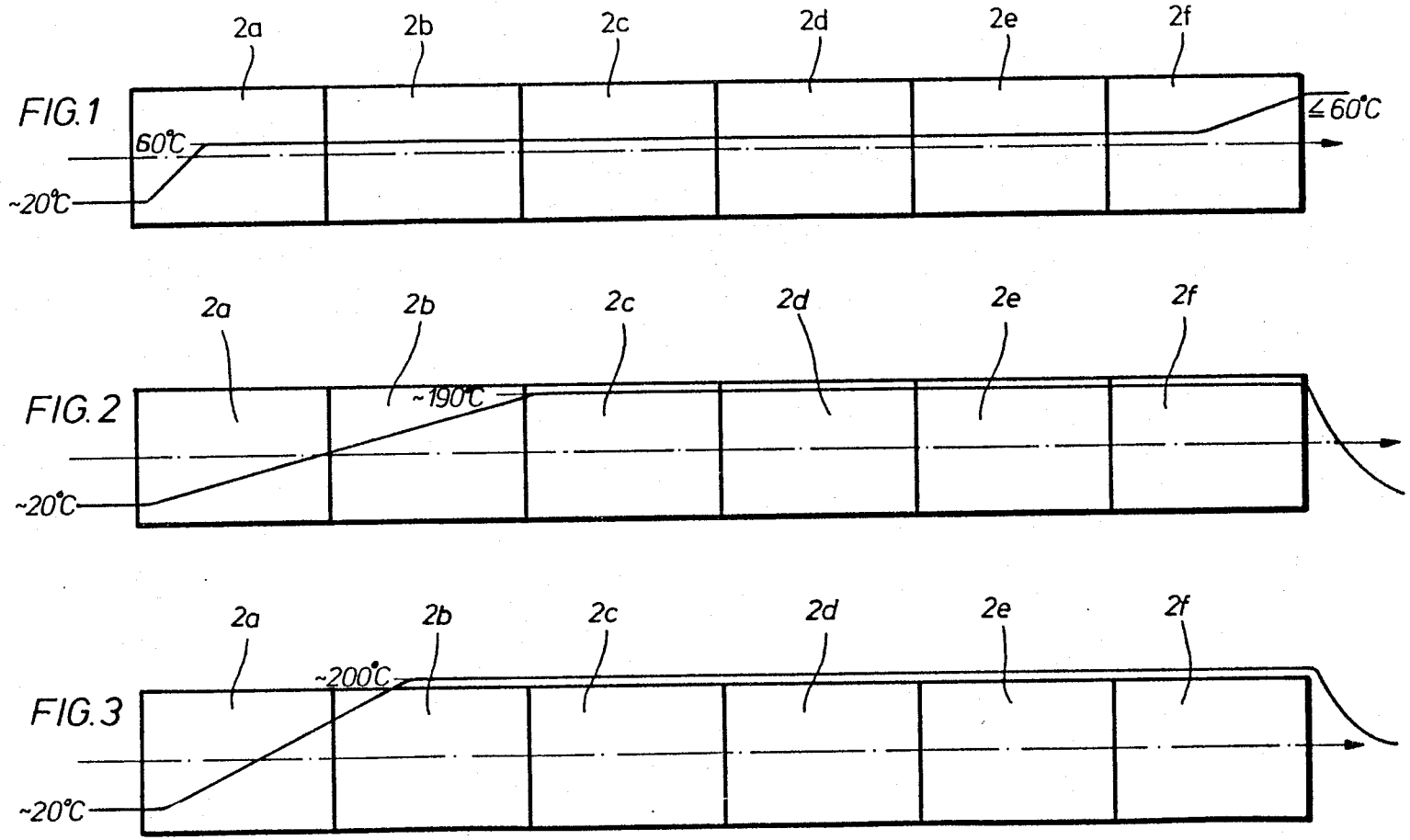
FIG. 1 is a diagram showing typical temperature readings throughout a tentering machine during a drying operation in the practice of the invention.
FIG. 2 is a similar diagram showing typical temperature readings during a fixing operation.
FIG. 3 is a similar diagram showing typical temperature readings during a condensing operation.

If a length of damp material is to be dried in a tentering machine using the method according to the invention, FIG. 1 shows in quite schematic form the course of the temperature of the length of material as it passes through the individual fields 2*a* to 2*f* of the tentering machine. The material to be dried is heated from room temperature (approximately 20° C.) to the so-called cool limiting temperature (of approximately 60° C.), that is to say to the temperature which the material reaches during drying under the given drying conditions. The temperature of the material only rises further after a specific residual moisture content (in field 2*f*) has been reached.

If a length of damp material is to be dried in a tentering machine using the method according to the invention, then first of all before commencement of heat treatment the timewise progress of the drying to be expected with predetermined drying temperature and moisture content of the exhaust air is predetermined as a material-specific characteristic value by measuring a material sample. This can be achieved using apparatus such as is the subject matter of German Patent Specification No. A-36 02 815.0. This apparatus makes it possible in a particularly simple manner to determine the timewise progress of the drying of a damp material sample, with the possibility of automation.

Then the speed of the tentering machine to be set is calculated from the timewise progress of the drying to be expected, the predetermined initial and residual moisture content of the length of material and the predetermined length of the drying zone.

During the heat treatment the residual moisture content of the material at the end of the drying zone and/or the temperature of the length of material at a predetermined position are measured as characteristic values of the heat treatment method. With the correction signal derived from this the speed of the tentering machine is altered if necessary.

Thus the drying speed of the material determines the machine speed. The quantity of water evaporating establishes the quantity of exhaust air.

FIG. 2 shows the temperature situation in a tentering machine during fixing of a length of material, that is to say during stabilisation of the dimensions of material made from PAM, PES and TZ.

The material must be heated from room temperature (approximately 20° C.) to fixing temperature (approximately 190° C). Since the temperature has to be reached right through the material and into the core of the fibre, there is generally a resting zone (fields 2*d* to 2*f*) connected to the actual heating zone (fields 2*a* to 2*c*). The resting period is generally selected so as to be proportional to the weight per unit area, taking empirical values into account. The quantity of exhaust air in the fixing process depends upon the proportion of impurities in the material and increases as the impurities increase.

In a corresponding manner FIG. 3 shows the course of the temperature in a tentering machine during the condensing of a length of material, i.e. during the polymerisation of materials provided with synthetic resins. The course of the temperature is similar to that in the case of fixing. The length of material is heated in a heating zone (fields 2*a*, 2*b*) from room temperature to approximately 200° C. and then rests for a long period (fields 2*c* to 2*f*) at this temperature. Less exhaust air is required for this.

If the fixing or condensing of a length of material is carried out in a tentering machine using the method according to the invention, then the weight per unit area of the material sample is determined as a material-specific characteristic value before the commencement of the heat treatment.

Then, taking account of this weight per unit area, the heating period after which the length of material reaches the fixing or condensing temperature under the predetermined heating conditions is calculated as well as the subsequent period during which the length of material rests at the fixing or condensing temperature.

Then the speed of the tentering machine is calculated from the heating period, the resting period and the predetermined length of the fixing or condensing zone and is set before the commencement of the heat treatment.

During the heat treatment the temperature of the length of material at a predetermined point in the fixing or condensing zone, preferably at the junction between the heating zone and the resting zone, is measured as a characteristic quantity for the heat treatment method and the speed of the tentering machine is altered by the correction signal derived therefrom.

Figure 4:
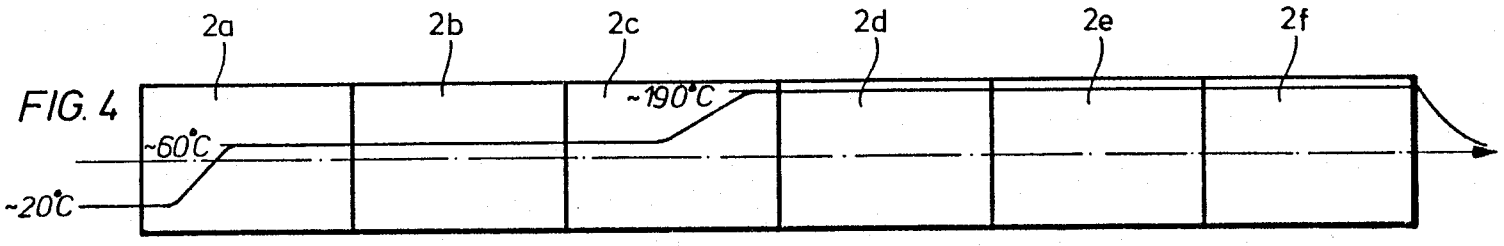
FIG. 4 is a similar diagram showing typical temperature readings during a drying-and-fixing operation.

FIG. 4 shows schematically the course of the temperature when a drying operation and a fixing operation are to be carried out in succession in one passage through the tentering machine. The diagram corresponds to a combination of the diagrams according to FIGS. 1 and 2 and does not need any further explanation.

Figure 5:
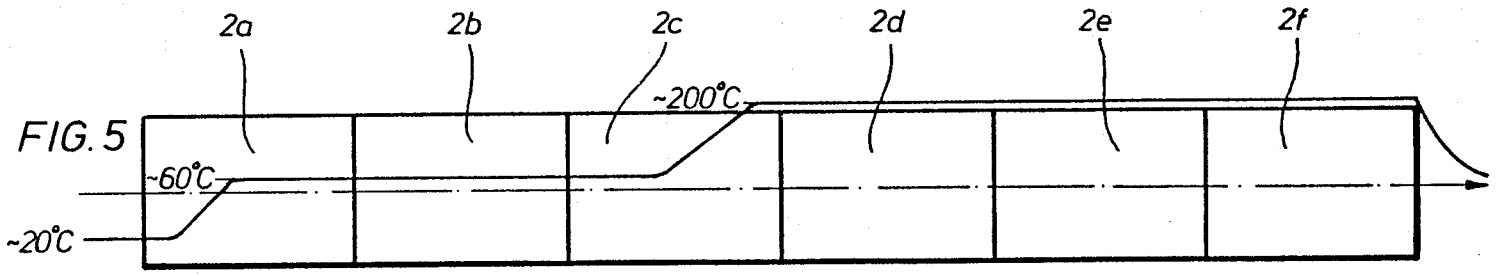
FIG. 5 is a similar diagram showing typical temperature readings during a drying-and-condensing operation.

Similarly, FIG. 5 shows the course of the temperature when a drying process and a condensing process are to be carried out in succession in one passage through the tentering machine. This illustration corresponds to a combination of those in FIGS. 1 and 3.

If drying and subsequent fixing and condensing of a length of material are carried out according to FIG. 4 or 5 in a tentering machine using the method according to the invention, then before the commencement of the actual heat treatment the weight per unit area of the material sample and the timewise progress of the drying to be expected with a predetermined drying temperature and moisture content of the exhaust air are determined as material-specific characteristic values.

The drying time, the heating time and the resting time at the fixing or condensing temperature are calculated from these material-specific characteristic values. Then the speed of the tentering machine is calculated from the sum of the drying time, heating time and resting time and the predetermined overall length of the heat treatment zone and is set before the commencement of the heat treatment. In addition, the lengths or the number of fields of the drying zone, heating zone and resting zone and the quantities, speeds and temperatures of the air for these zones are determined from the drying time, the heating time and the resting time and are set before the commencement of the heat treatment.

During the heat treatment the residual moisture content of the length of material at the end of the drying zone, the temperature of the length of material at a predetermined point, preferably in the region of the heating zone, and/or the locations at which the temperature of the length of material alters markedly are measured as characteristic quantities for the heat treatment method and with the correction signal derived therefrom the speed of the tentering machine is altered. The actual location of the end of the drying zone, i.e. the point at which the length of material shows its residual moisture content and the temperature increase of the heating zone begins, is particularly suitable as a characteristic quantity.

During the heat treatment the temperature of the length of material at at least one predetermined point is measured as a further characteristic quantity for the heat treatment method and the quantity, speed and/or temperature of the air at this point is altered by the correction signal derived therefrom.

It can also be advantageous for the method according to the invention if not only the timewise progress of the drying to be expected with a predetermined drying temperature and residual moisture content in the exhaust air but also the heating speed to be expected with predetermined heating conditions are determined as material-specific characteristic values before the commencement of the actual heat treatment. With the material-specific characteristic values obtained in this way it is possible for the whole course of the heat treatment processes described above to be determined in advance and for the tentering machine to be preset accordingly.

These presettings relate not only to the machine speeds, the quantities of air, the speeds of the air (set by the blower speeds), but also of course to the process-related air temperatures in the different regions. For instance drying is carried out at comparatively low temperatures (at approximately 150° C.) in order to produce particular material properties, whilst the thermofixing and condensing are carried out at higher temperatures.

According to a further embodiment of the method according to the invention not only the timewise progress of the drying to be expected with a predetermined drying temperature and residual moisture content of the exhaust air (and if necessary also the weight per unit area of the material) but also laboratory shrinkage data are determined with the aid of a material sample as material-specific characteristic values before the commencement of the heat treatment.

In order for the product to have a desired weight per unit area whilst keeping to a specific working width, appropriate allowance must be made for shrinkage in the length during the heat treatment. This is achieved by setting different speeds for the rollers arranged before and after the tentering machine, and at the same time the tensioning layout of the length of material is set by altering the distances between the chain rails of the tentering machine.

Thus in the method according to the invention the speeds of the rollers arranged before and after the tentering machine and/or the distances between the chain rails are advantageously calculated with the aid of the determined shrinkage data and are set before the commencement of the heat treatment.

To summarise, the material-specific characteristic values which are determined (in particular the timewise progress of drying, the weight per unit area of the material and laboratory shrinkage data) are used so that the configuration of the tentering machine can be completely fixed, preferably with the air of a computer, before the commencement of the heat treatment. In detail this can mean:

The air temperatures in the different zones of the tentering machine are set in relation to the process.

The machine speed is calculated and preselected.

The differential speeds of the rollers in the machine inlet and the machine outlet are calculated and set.

The spindles for setting the tensioning layout, i.e. the distances between the chain rails, are positioned correctly for the particular product.

The exhaust air valves in the drying and fixing zone are set for the particular process.

Of the sensors for the temperature of the length of material (mostly pyrometers) one suitable measuring system is advantageously selected from the heating zone; its signal is mathematically weighted and fed back to the regulation means for the machine speed.

The blower speeds are preselected.

The most economic manner of operation possible is desired whilst at the same time treating the material with care, and with this in view the air speeds in the individual regions of the tentering machine are advantageously set so as to be different. In one zone in which heat is to be transferred to the length of material, particularly in the drying and heating zone, a high air speed is set, preferably the highest air speed possible for the material in question. On the other hand, in a zone in which the length of material rests at a temperature which has already been reached without significant heat absorption a low air speed is set, preferably a speed which is just sufficient to keep the temperature constant. In this way the total energy requirement of the tentering machine can be minimised.

In a corresponding manner the type of material to be treated is also taken into account in the choice of air speed. Thus a dense, robust material can be treated at significantly higher speeds than a very delicate sheet material (such as crepe).

However, it is not only the circulating air but also the exhaust air from the tentering machine which is optimised according to the invention.

In the drying of a length of material the quantity of exhaust air required for this purpose is calculated from the timewise progress of the drying which has been determined, the initial and residual moisture content of the length of material and the predetermined moisture content of the exhaust air, and this quantity is set before the commencement of the heat treatment. During the heat treatment the moisture content of the exhaust air is measured as a further characteristic quantity for the method of heat treatment and the quantity of exhaust air is altered by the correction signal derived therefrom.

In the fixing or condensing of a length of material the level of impurities in the material (i.e. the quality of the prior treatment), particularly the content of spinning and spooling oils contained in the material, is determined as a further material-specific characteristic value. From the level of impurities which is established and the weight per unit area of the material the quantity of exhaust air in the fixing or condensing zone is calculated as a further parameter for the heat treatment method and is set before the commencement of the heat treatment. Then during the heat treatment the carbon content of the exhaust air from the fixing and condensing zone is determined as a further characteristic value for the method of heat treatment and with the correction signal derived therefrom the quantity of exhaust air is altered.

I claim:

1. A method for treating a length of material at an elevated temperature in a tentering machine wherein the untreated material has at least one material-specific characteristic (A), wherein the extent of the treatment is dependent upon at least one adjustable treatment parameter (B), wherein the extent of the treatment is characterized by at least one measurable condition within the tentering machine (C), wherein there is a relationship between A, B, and C, and wherein there is a relationship between changes in B and changes in C, the steps of the method comprising:

(a) measuring A;

(b) before commencement of the treatment, calculating a first value of B using the measured value of A, a desired value of C, and the relationship between A, B and C;

(c) presetting B to the first value of B;

(d) commencing the treatment and then measuring a first actual value of C;

(e) comparing the desired value of C to the first actual value of C;

(f) calculating a second value of B capable of yielding a second actual value of C which more closely matches the desired value of C (than does the first actual value of C) using the comparison between the desired value of C and the first actual value of C and using the relationship between changes in B and changes in C; and (g) resetting B to the second value of B.

2. Method as claimed in claim 1, characterized in that the speed of the tentering machine is the adjustable treatment parameter (B) of the method of treatment, and the measurable characteristic of the extent of treatment (C) is the length of the heat treatment zone.

3. Method as claimed in claim 1 adapted for drying a length of damp material in a tentering machine, characterized by the following features:

(a) the speed of the tentering machine is the adjustable treatment parameter (B) calculated from the timewise progress of the drying to be expected, the predetermined initial and residual moisture content of the length of material and the predetermined length of the drying zone;

(b) the residual moisture content of the length of material and/or the temperature of the length of material at a predetermined point are the measurable characteristics of the extent of treatment (C) measured as characteristic quantities for the method of heat treatment and the speed of the tentering machine is altered by the correction signal derived therefrom.

4. Method for fixing or condensing a length of material in a tentering machine, characterized by the following features:

(a) the weight per unit area of the material sample is determined as a material-specific characteristic value;

(b1) then, taking account of this weight per unit area, the heating period after which the length of material reaches the fixing or condensing temperature under the predetermined heating conditions is calculated as well as the subsequent period during which the length of material rests at the fixing or condensing temperature;

(b2) then the speed of the tentering machine is calculated from the heating period, the resting period and the predetermined length of the fixing or condensing zone and is set before the commencement of the heat treatment;

(c) during the heat treatment the temperature of the length of material at a predetermined point in the fixing or condensing zone, preferably at the junction between the heating zone and the resting zone, is measured as a characteristic quantity for the heat treatment method and the speed of the tentering machine is altered by the correction signal derived therefrom.

5. Method for drying and subsequent fixing or condensing of a length of material in a tentering machine, characterized by the following features:

(a) the following are determined as material-specific characteristic values;

(a1) the weight per unit area of the sample (a2) the timewise progress of the drying to be expected with a predetermined drying temperature and moisture content of the exhaust air are determined as material-specific characteristic quantities;

(b1) the drying time, the heating time and the resting time at the fixing or condensing temperature are calculated from these material-specific characteristic values;

(b2) then the speed of the tentering machine is calculated from the sum of the drying time, heating time and resting time and the predetermined overall length of the heat treatment zone and is set before the commencement of the heat treatment;

(b3) in addition, the lengths or the number of fields of the drying zone, heating zone and resting zone and the quantities, speeds and temperatures of the air for these zones are determined from the drying time, the heating time and the resting time and are set before the commencement of the heat treatment;

(c1) during the heat treatment the residual moisture content of the length of material at the end of the drying zone, the temperature of the length of material at a predetermined point, preferably in the region of the heating zone, and/or the locations at which the temperature of the length of material alters markedly are measured as characteristic quantities for the heat treatment method and with the correction signal derived therefrom the speed of the tentering machine is altered;

(c2) during the heat treatment the temperature of the length of material at least one predetermined point is measured as a further characteristic quantity for the heat treatment method and the quantity, speed and/or temperature of the air at this point is altered by the correction signal derived therefrom.

6. Method as claimed in claim 1, characterized in that (a1) the timewise progress of the drying to be expected with a predetermined drying temperature and residual moisture content in the exhaust air;

(a2) and the heating speed to be expected with predetermined heating conditions are determined as measurable characteristics of the extent of treatment (C).

7. Method as claimed in claim 1, characterized in that (a1) the timewise progress of the drying to be expected with a predetermined drying temperature and residual moisture content of the exhaust air and (a2) the shrinkage of the material during tentering are determined as measurable characteristics of the extent of treatment (C) with the air of a material sample.

8. Method as claimed in claim 7, in which in order to achieve a desired weight per unit area with a predetermined width of the length of material, rollers arranged before and after the tentering machine are driven at different, adjustable speeds and/or the tensioning layout of the length of material is set by altering the distances between the chain rails of the tentering machine, characterized in that (b1) the speeds of the rollers are arranged before and after the tentering machine (b2) and/or the distances between the chain rails are calculated from the shrinkage of the material and are set before the commencement of the heat treatment.

9. Method as claimed in claim 5, characterised in that in a zone in which heat is to be transferred to the length of material, particularly in the drying and heating zone, a high air speed is set, preferably the highest air speed possible for the material in question.

10. Method as claimed in claim 5, characterised in that in a zone in which the length of material rests at a temperature which has already been reached without significant heat absorption a low air speed is set, preferably a speed which is just sufficient to keep the temperature constant.

11. Method as claimed in claim 3 for drying a length of damp material, characterised by the following further features:

(b1) the quantity of exhaust air required is calculated from the timewise progress of the drying which has been determined, the initial and residual moisture content of the length of material and the predetermined moisture content of the exhaust air, and this quantity is set before the commencement of the heat treatment;

(c1) during the heat treatment the moisture content of the exhaust air is measured as a further characteristic quantity for the method of heat treatment and the quantity of exhaust air is altered by the correction signal derived therefrom.

12. Method as claimed in claim 4 for fixing or condensing a length of material, characterised by the following further features:

(a1) the level of impurities in the material, particularly the oil content of the material, is determined as a further material-specific characteristic value;

(b3) from the level of impurities which is established and the weight per unit area of the material the quantity of exhaust air in the fixing or condensing zone is calculated as a further parameter for the heat treatment method and is set before the commencement of the heat treatment;

(c1) during the heat treatment the carbon content of the exhaust air from the fixing or condensing zone is determined as a further characteristic value for the method of heat treatment and with the correction signal derived therefrom the quantity of exhaust air is altered.

13. Method as claimed in claim 1, characterized in that (a1) the timewise progress of the drying to be expected with the predetermined drying temperature and moisture content of the exhaust air, (a2) the heating speed to be expected under the predetermined heating conditions, (a3) and laboratory data, particularly shrinkage data, are determined as measurable characteristics (C) with the aid of a material sample.

* * * * *